US006007246A

United States Patent [19]

Kinigakis et al.

[11] Patent Number: 6,007,246

[45] Date of Patent: Dec. 28, 1999

[54] RECLOSABLE CONTAINER ARRANGEMENT

[75] Inventors: Panagiotis Kinigakis, West Windsor, N.J.; Christie Lynn Langer, New City, N.Y.

[73] Assignee: Kraft Foods Inc., Northfield, Ill.

[21] Appl. No.: 09/162,794

[22] Filed: Sep. 29, 1998

[51] Int. Cl.[6] ..... B65D 33/16

[52] U.S. Cl. ..... 383/204; 383/63; 383/104; 383/906

[58] Field of Search ..... 383/61, 63, 65, 383/906, 200, 203, 204, 209, 104; 222/107

[56] References Cited

U.S. PATENT DOCUMENTS

| | | | |
|---|---|---|---|
| Re. 34,347 | 8/1993 | VanErden et al. | 383/63 |
| 2,620,944 | 12/1952 | Stahl | 383/200 |
| 3,208,640 | 9/1965 | Paulson | 383/91 |
| 3,387,701 | 6/1968 | Schneider et al. | 383/104 |
| 3,389,733 | 6/1968 | Siegel | 383/65 |
| 3,397,835 | 8/1968 | Henning | 383/209 |
| 3,640,381 | 2/1972 | Kanada et al. | 383/104 |
| 3,815,810 | 6/1974 | Wellman | 383/61 |
| 4,290,467 | 9/1981 | Schmidt | 150/3 |
| 4,332,344 | 6/1982 | Strodthoff | 383/63 |
| 4,361,235 | 11/1982 | Gautier | 383/104 |
| 4,691,373 | 9/1987 | Ausnit | 383/63 |
| 4,745,731 | 5/1988 | Talbott et al. | 53/451 |
| 4,787,755 | 11/1988 | Branson | 383/65 |
| 4,846,586 | 7/1989 | Bruno | 383/9 |
| 4,923,309 | 5/1990 | Van Erden | 383/61 |
| 4,998,646 | 3/1991 | Sherman | 222/107 |
| 5,059,036 | 10/1991 | Richison et al. | 383/63 |
| 5,417,035 | 5/1995 | English | 383/61 |
| 5,435,864 | 7/1995 | Machacek et al. | 383/61 |
| 5,456,928 | 10/1995 | Hustad et al. | 383/61 |
| 5,525,363 | 6/1996 | Herber et al. | 383/9 |
| 5,577,305 | 11/1996 | Johnson | 24/587 |
| 5,611,626 | 3/1997 | Warr | 383/10 |
| 5,716,473 | 2/1998 | Gordon et al. | 156/200 |

FOREIGN PATENT DOCUMENTS

| | | | |
|---|---|---|---|
| 6127552 | 5/1994 | Japan | 383/104 |

*Primary Examiner*—Stephen P. Garbe
*Attorney, Agent, or Firm*—Thomas A. Marcoux; Thomas R. Savoie

[57] ABSTRACT

A reclosable bag-like container which is constituted of a flexible semi-rigid plastic material and which is adapted to store pourable contents, preferably, such as dry cereals, snacks, sugar, salt, cake mixes and similar types of foodstuffs or comestibles. The container includes a resealable corner dispensing spout which can be closed by interengaging slide fastener elements.

23 Claims, 4 Drawing Sheets

RECLOSABLE CONTAINER ARRANGEMENT

BACKGROUND OF THE INVENTION

1. Field of the Invention

The present invention relates to a reclosable bag-like container which is constituted of a flexible material and which is adapted to store pourable food products; for instance, such as dry cereals, or semi-moist products.

Currently, in the packaging technology, and particularly the facets thereof which concern themselves with the packaging and storage of dry cereals, among similar foodstuffs which are in granular form, it is generally the custom to employ an inner bag which is normally constituted of a moisture-impervious flexible plastic or wax-coated material and which receives and stores the contents or foodstuffs until such time as it is desired to dispense the dry cereal contents or portions thereof as may be desired by a consumer. In that connection, an upper sealed edge of the flexible plastic container, which is in the form of the inner bag, is ripped open by the consumer, normally along a previously formed heat seal, and the contents of the bag dispensed to the extent desired. Inasmuch as flexible bags or containers of that type are generally not self-supporting, they are normally placed within the outer container, which is ordinarily constituted of a substantially rigid paperboard or similar laminated material, and wherein the outer container is of a primarily rectangular parallelipiped configuration internally dimensioned to easily receive the inner bag, and wherein the outer container is adapted to be reclosed by means of overlapping flaps with interengageable tab and slit fastener structures. This, in essence necessitates the production and positioning two containers one within the other; namely an inner flexible bag-like container storing the contents, which is essentially not resealable in nature but is merely closed by folding over the previously ripped open upper edge portion, and the outer cardboard container which is only reclosed by means of the interengaging tab and slit structure formed on upper flaps thereof. This type of container arrangement, besides being expensive inasmuch as it necessitates the separate manufacture of product-receiving flexible plastic/waxed paper bags and of the rigid paperboard containers, and the assembling thereof, requires a relatively large storage and store display shelf spaces, while failing to preserve the desired integrity of the stored contents inasmuch as the containers are not hermetically resealed, thereby adversely effecting the shelflife and freshness of the comestible contents over any extended periods of time.

More recently, in order to improve upon the foregoing packaging technology, and, in particular, eliminate the necessity in providing for an outer rigid container, generally such as a rectangular paperboard container housing an inner flexible waxed paper or plastic bag storing dry pourable foodstuff contents therein, there have been developed essentially semi-rigid self-supporting flexible containers for dry foodstuffs, such as dry cereals, in an attempt to eliminate the need for an outer rigid container. This, not only provides for a simpler and less expensive package construction, but also avoids the need for outer paperboard or cardboard containers which, under some storage conditions, may attract insects or rodents, and which may also be readily susceptible to environmental damage encountered during long-term storage, possibly due to external moisture and humidity conditions or the like. Pursuant to the technology, consideration has also been given to the development of reclosable packages, in which cooperating closure elements, such as male and female profile members, enable the sealed reclosing of the package or bag, thereby protecting the contents from external and environmental influences.

2. Discussion of the Prior Art

Gordon et al, U.S. Pat. No. 5,716,473 discloses a semi-rigid cereal carton which is constituted of paperboard having the interior surface thereof coated with a thermoplastic polymer barrier layer, and possibly covered with a further moisture-imperious outer layer. The semi-rigid construction of the carton which in cross-section is vertically essentially of a trapezoidal configuration, having a wide self-supporting bottom of rectangular configuration, includes an upper edge with an openable sealed corner structure, in which the corner of the upper edge is adapted to form a pouring spout for the dispensing of the dry cereal contents. Thereafter, subsequent to the dispensing of predetermined quantities of the container contents, the latter may be reclosed by simply pressing the spout portions together and in which adhesive contact surfaces will reclose the spout. This structure is rather complex and necessitates the use of an adhesive which frequently has the dry granular or flaked contents of the container adhering thereto during and after pouring, thereby inhibiting the hermetically sealed reclosing of the container corner pouring spout structure. This potential adverse influence over the integrity of the seal prevents the remaining dry cereal or foodstuff in the container to be stored in a condition of freshness over any extended period of time.

Warr, U.S. Pat. No. 5,611,626 discloses a flexible plastic bag incorporating structure adapted to contain dry comestibles and other types of contents in a sealed condition, and wherein an upper corner portion of the essentially rectangular bag is provided with a tear line adapted to enable tearing of a corner patch thereof so as to produce a chamfered or tapered corner pouring spout. A strip which contains an adhesive on one surface thereof is adapted to be peeled from its position on an upper outer surface portion of the bag, and adhesively placed over the pouring spout subsequent to the dispensing of portions of the bag contents, so as to form a closure sealing in the remaining bag contents. This patent provides for a complex structure wherein the separate strip must be manually detached from the bag and placed over the corner portion of the bag which has the pouring spout, so as to provide the reclosable seal of the bag. Repetitive removal of the strip containing the adhesive and opening of the pouring spout therewith may cause the seal to loose its effectiveness, thereby adversely affecting the freshness and quality of the contents of the bag over any longterm storage periods.

More recently, reclosable flexible or semi-rigid plastic containers or bags have been developed in the packaging technology wherein the bags may be reclosed through the intermediary of so-called slide fasteners; in essence, interengageable profiled male and female members or tongue-and-groove elements, generally of plastic material. These fasteners are formed along openable edge portions of the bags, and upon being separated to allow for the dispensing of portions of the contents as may be required by a consumer, are thereafter resealed by simply reengaging the profiled male and female fastener members and applying pressure thereto along the length thereof.

Various types of such slide fasteners are well known in the packaging art and have been developed in the technology so as to be either integrally formed with the material of the bag walls, or formed as strips which are suitably sealed or fastened to the interior surfaces of facing or opposing sidewalls of the bags or containers, and are adapted to be separated to form a bag opening by being pulled apart and reclosed by a simple physical application of pressure by a consumer, and wherein the pressure is adapted to be applied along the length of the interengageable profile male and female fastener members so as to form a generally hermetic seal along the full length of the opening formed in the bag or container.

Thus, Branson, U.S. Pat. No. 4,787,755 discloses a flexible bag-like container wherein reclosable fastener elements include cooperable zipper-like structure consisting of male and female profiled elements adapted to form a pouring spout. In one embodiment, the fasteners are attached to external surfaces of the container in an angled corner configuration to provide a corner pouring spout which can be reclosed by folding over of the container material and joining the profiled fasteners together. This necessitates a complex folding-over and fastener aligning procedure which cannot be always easily implemented by a user.

Among other disclosures of flexible bag structures incorporating interengageable profiled male and female or tongue-and-groove type slide fasteners are Schmidt, U.S. Pat. No. 4,290,467; Van Erden, et al., U.S. Reissue Pat. No. Re 34,347; Bruno, U.S. Pat. No. 4,846,586; Johnson, U.S. Pat. No. 5,577,305; and Talbott U.S. Pat. No. 4,745,731, also setting forth apparatus and methods for producing packaging and container flexible structures employing differing types of interengagable profiled male and female fastener arrangements.

Although, in general, the foregoing patent publications provide for an adequate resealing of flexible plastic bags or containers so as to again form essentially hermetically sealed packaging structures protective of the remaining contents which are stored therein, ordinarily the reclosable seals are formed so as to extend along the entire length of an edge of the usually rectangularly shaped plastic container. Thus, the separation of the profiled male and female fasteners elements may produce an inordinately large bag opening, causing the rapid and frequently excessive dispensing of the bag contents, often by children of tender age. Also, the reclosing of such relatively large openings formed by the separation of the bag fastener elements may be implemented by children or others who are either not concerned with the complete reclosing of the bag or container, or improperly realigning the elements so as cause the bag to remain open or to be improperly reclosed.

SUMMARY OF THE INVENTION

Accordingly, in order to improve upon the foregoing bag closure arrangements for semi-rigid or flexible bag-like containers, which may also be adapted to be employed without the need for encompassing outer paperboard cartons or storage containers as is commonly employed in the packaging of dry cereals, the present invention is directed to the provision of a sealed rectangular or parallelipiped bag, or possibly tubular, sleeve-shaped or contoured, bag, with at least one of the end corners of the bag being provided with a reclosable dispensing opening facilitating the resealing of the dispensing opening. In order to provide the novel resealable opening or closure which will impart an enhanced control over the dispensing rate of the contents or dry cereal being dispensed, the bag has the reseable corner opening in the form of a structure in which reclosable interengagable profiled slide fastener members are located at an angle or chamfer, to produce a corner pouring spout which is substantially smaller than the width of the bag.

With respect to attaining the foregoing bag closure arrangement, the invention provides for the angled corner formation of the interengageable profiled fastener components which are complementary male and female members, which may be of the tongue and groove type, such components being integrally formed with the bag material or heat sealed in the form of strips to the interior facing surfaces of the side walls of the bag. Such fastener components are readily disengaged by simply imparting a separating pulling or "zipper-like" action thereto so as to form the opened dispensing spout. Thereafter, subsequent to the dispensing of the desired amounts of the contents of the bag, the interengageable profiled male and female profile members are pressed together so as to interengage and such pressure slidingly maintained along the length thereof to thereby reseal the bag.

The corner segment of the bag located towards the outside of the interengageable profiled slide fastener member may be imparted weakening lines i.e. laser scored, or perforations extending in parallel spaced relationship with the fastener members, thereby enabling tearing off of the corner segment of the bag, and to produced pulling or separating flange portions adjacent the slide fastener members. Moreover, it is also possible to provide a heat seal of the bag exteriorly of the perforation or weakening line, i.e. laser score, so as to initially ensure that the interior of the bag is completely sealed prior to the separation of the slide fastener members.

Pursuant to a further aspect of the invention, the opposite or lower or bottom end of the bag may be of a widening configuration forming a bottom surface and flanges on opposite sides thereof which will facilitate the upright positioning of the bag and its contents in a self-supporting mode, such as when stored or located on a display shelf. This will assist in eliminating the necessity for the provision of the generally rigid and space-consuming outer paperboard containers normally employed in the packaging of dry cereals which are stored within flexible inner bags housed in the outer containers.

Accordingly, it is an object of the present invention to provide a reclosable flexible container for pourable contents, including food products such as dry cereals or the like, which is essentially of a rectangular parallelipiped, tubular sleeve-like or contoured construction, and which includes a reclosable corner dispensing opening adjacent the upper edge of at least one side wall.

Another object of the invention is to provide a reclosable packaging container as described herein, wherein the reclosable dispensing opening comprises interengagable profiled male and female members forming a slide fastener.

Yet another object of the present invention is to provide a generally semi-rigid self-supporting container for the storage of pourable contents, such as cereals or the like, in which one corner of the bag incorporates a reclosable pouring spout wherein closing elements consisting of interengagable profiled male and female elements form a slide fastener which is sealable upon external pressure being applied thereto.

A still further object of the present invention resides in the provision of a container as described herein, wherein weakening lines or perforations are formed in the container sidewalls in parallel spaced relationship outwardly of the reclosable slide fastener so as to enable tearing away of a corner portion of the container and thereby forming flanges for pulling apart the reclosable profiled fasteners elements to produce the dispensing opening.

BRIEF DESCRIPTION OF THE DRAWINGS

Reference may now be had to the following detailed description of a preferred embodiment of a reclosable container pursuant to of the invention, taken in conjunction with the accompanying drawings; in which.

DETAILED DESCRIPTION OF A PREFERRED EMBODIMENT

Figure 1:
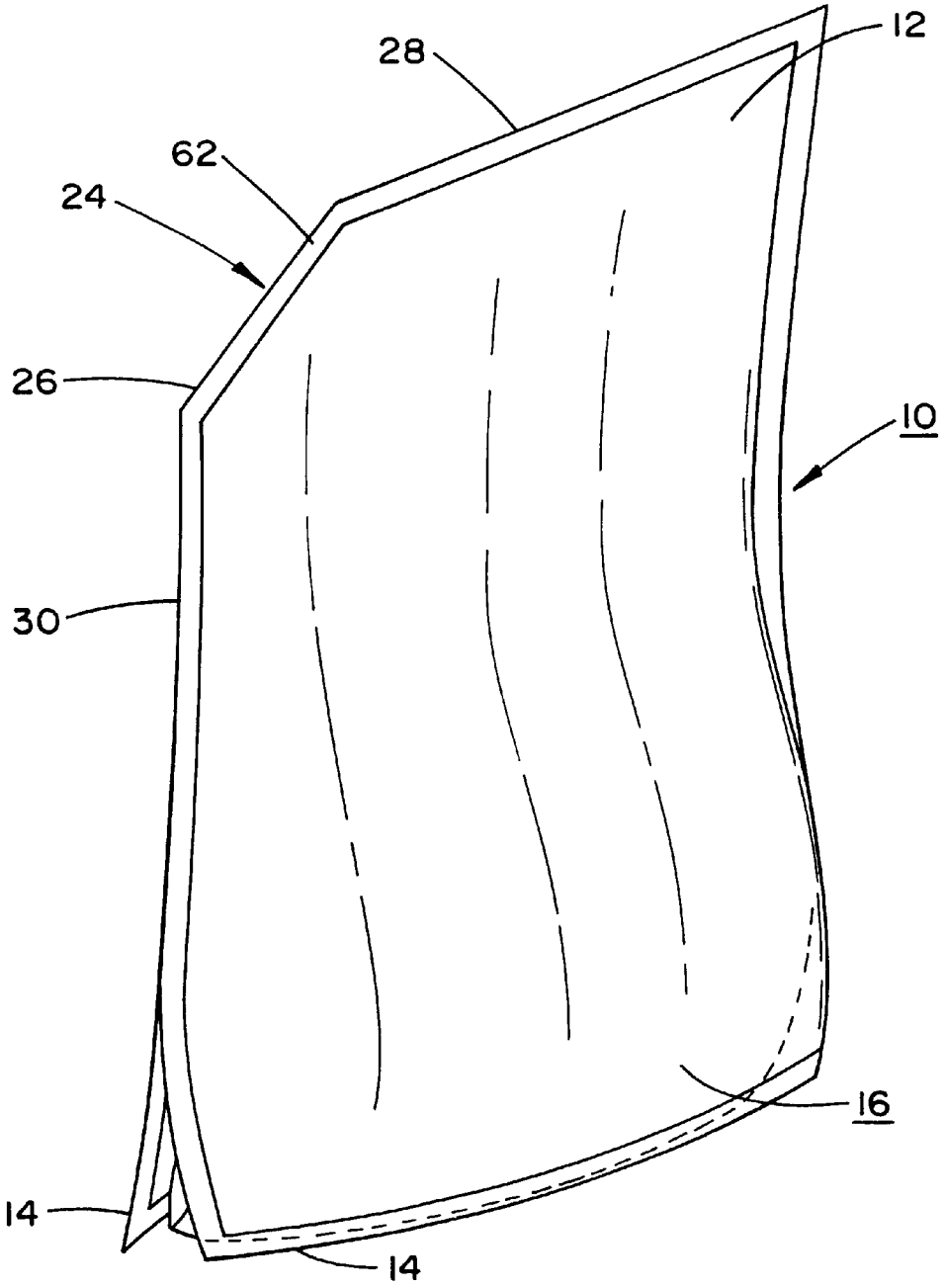
FIG. 1 illustrates a perspective front and side view of a reclosable semi-rigid and flexible plastic bag for the packaging of pourable dry contents, pursuant to the invention.
Figure 3:
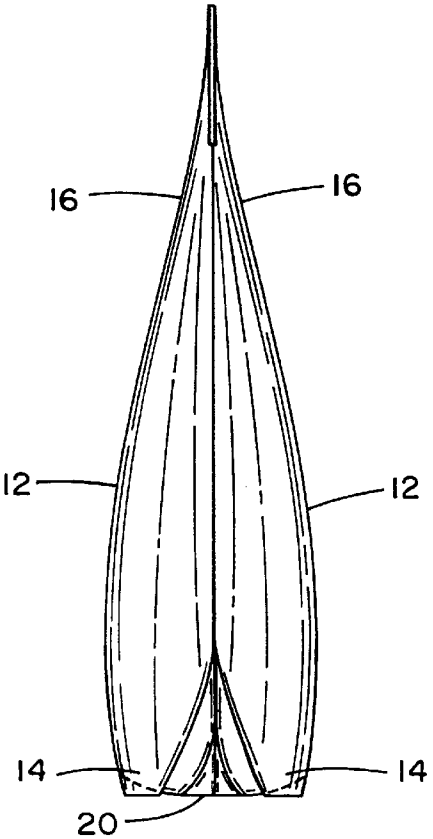
FIG. 3 illustrates a front view of the container of FIG. 1.
Figure 2:
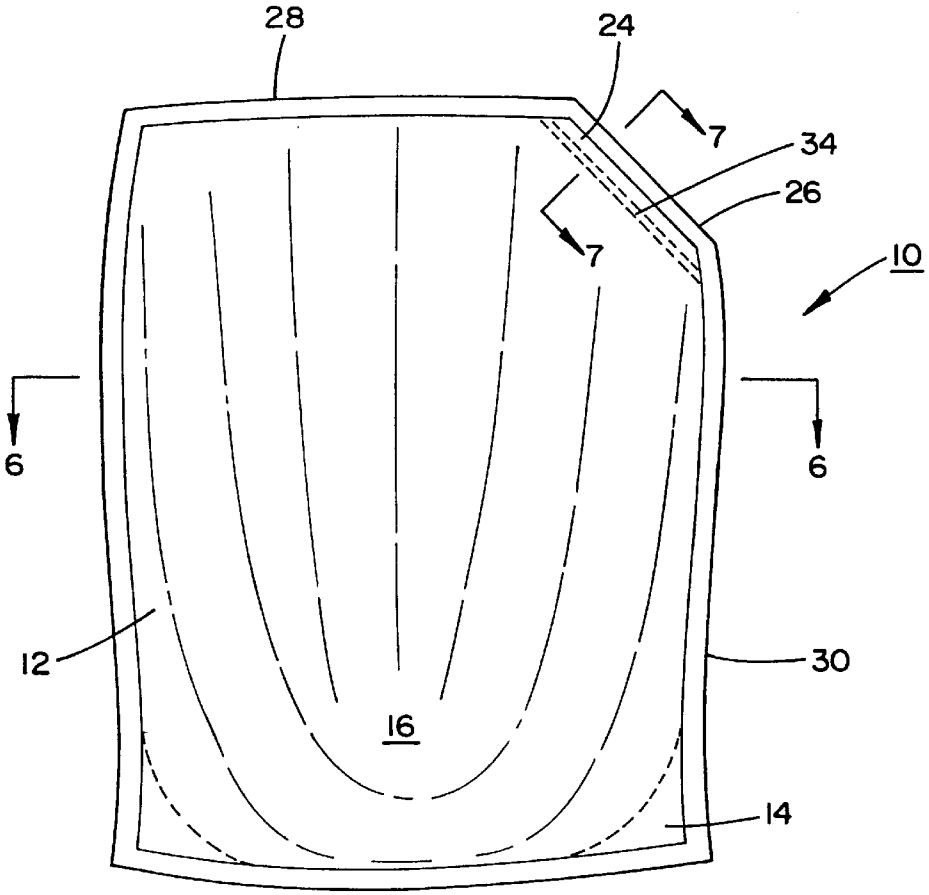
FIG. 2 illustrates a side view of the container of FIG. 1.
Figure 4:
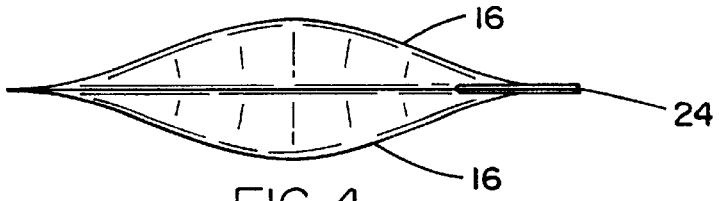
FIG. 4 illustrates a top plan view of the container of FIG. 1.

Referring now in detail to the drawings, FIG. 1 illustrates a container comprising generally semi-rigid flexible plastic bag 10 for the packaging of the dry pourable contents; for example, such as dry cereals.

The bag 10 may be constituted from two separate sheets of plastic material, or alternatively, formed from a single tubular sheet of plastic material in accordance with the particular method and apparatus employed for producing the bag. The material of the bag is essentially a single layer or multilayer of plastic, paper or metallized plastic material which will, over lengthy storage periods, preserve the freshness and integrity of the contents stored therein under sealed conditions, preferably essentially hermetically sealed, and wherein the exterior surfaces 12 of the container or bag 10 may be provided with suitable embossed or imprinted indicia, legends and/or decorative single or multi-colored information which is representative and informative over the contents of the bag and the identity of the manufacturer or producer of the products contained therein.

Figure 5:
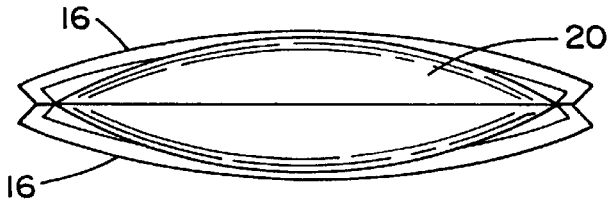
FIG. 5 illustrates a bottom view of the container.
Figure 6:
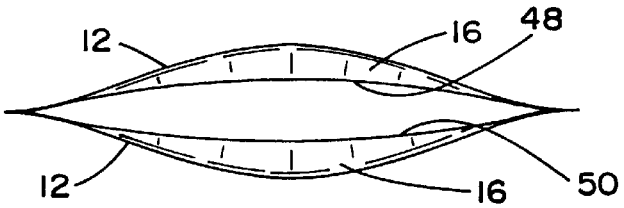
FIG. 6 illustrates a sectional view taken along line 6—6 in FIG. 1.

As illustrated particularly in drawing FIGS. 2 through 6, the bag 10 is essentially of a rectangular configuration viewed in side elevation, and wherein the lower portions 14 of the bag side walls 16 may expand or be spread apart so as to form a widening bottom or bag base 20 of generally ovoid configuration, as shown in FIG. 5. The ovoid configuration of the bottom 20 of the bag 10 which is formed by the material of the bag side walls 16, and the lower edges of the side walls which are of a convex curvilinear configurational relative to each other in horizontal transverse view, forms a bag bottom of essentially a "skirt-like" shape, imparting a flat supporting structure thereto so as to enable the bag 10 to be self-supporting in an upright position when resting on a generally horizontal supporting surface, such as a shelf or in a cupboard or the like.

Pursuant to the invention, a dispensing orifice or pouring spout 24 which is of a reclosable sealable nature is formed at an upper corner 26 of the bag 10 intermediate an upper horizontal edge 28 and at least one vertical edge 30 of the side walls 16, such corner pouring spout or dispensing orifice 24 subtending an angle within the range of approximately 25° to 65°, with respectively the upper horizontal and the vertical side edges 28, 30 of the bag corner 26, although it is possible to contemplate that other angles may be formed by a suitable chamfered or tapered corner pouring spout, as may be desired for the particular contents which are to be stored in the bag and dispensed therefrom. The width of the corner pouring spout or orifice 24 may be up to about 50% or one-half the width of the upper edge 28, or may be smaller depending upon the size of the bag and type of contents.

Figure 7:
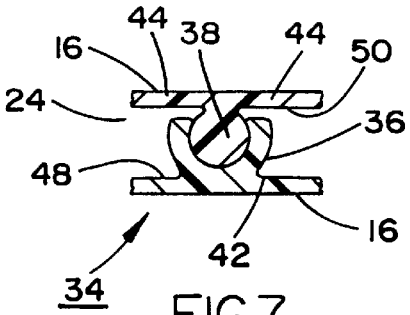
FIG. 7 illustrates a sectional view, on an enlarged scale, taken along line 7—7 in FIG. 1.

As illustrated in more specific detail in FIG. 7 of the drawings, the corner dispensing or pouring spout 24 of the bag 10 is adapted to be resealed, preferably hermetically sealed, subsequent to dispensing of portions of the bag contents, through the provision of interengagable profiled slide fastener structure 34, wherein a profiled female element 36 is adapted to be engaged in a complimentary profiled male element 38 upon being superimposed, and external pressure being applied to that slide fastener structure 34 portion of the bag 10 and the pressure slidingly extended along the length of the pouring spout 24 which is present between the interengagable profiled fastener elements 36, 38.

The profiled slide fastener structure 34 which is shown in the drawing, comprises a first plastic strip 40 the length of the dispensing orifice 24, which in transverse cross-section forms the profiled male element 38 in a generally round shape adapted to engage in the C-shaped profiled female element 36 which is formed on a separate plastic 42 strip, and may have a single flange 44 on one side of the element for one of the strips, and a double-sided flange 46 for the other strip. The strips 40, 42 which are of a similar or somewhat more rigid plastic material as the bag 10 or container sidewalls 16 are heat welded or sealed to the interior facing surfaces 48, 50 of the opposing sidewalls 16 in parallel aligned relationship. Alternatively, the profiled male and female elements 36, 38 forming the reclosable slide fastener structure 34 may be integrally formed with the material of the plastic bag sidewalls 16, the function thereof being identical with that as described hereinabove. Furthermore, although the profiled fastener elements are described as being profiled male and female elements which in transverse cross-section possess a round male element adapted to engage into a C-shaped female fastener element, other shapes readily lend themselves to the invention in order to form any type of socalled tongue-and-groove interengagable fastener structures.

Figure 8:
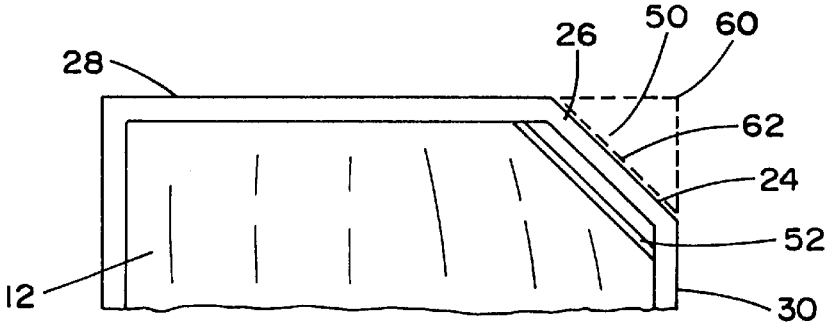
FIG. 8 illustrates, on an enlarged scale, a detail of the closure-forming corner portion of FIG. 1.

As indicated in FIG. 8 of the drawings, although the plastic container is initially of a completely rectangular configuration, for the purpose of forming the corner pouring spout or dispensing orifice 24, weakening lines or perforation 50 may be formed aligned with each other in the sidewalls 16 in parallel spaced relationship outside of the reclosable profiled slide fastener structure 34, which are initially in an interengaged sealingly closed condition. In that connection, it is optionally possible to form a frangible heat seal 52 between the sidewalls 16 interiorly of the reclosable profiled fastener structure 34 so that prior to the opening of the bag 10 through separation of the slide fastener structure, this will ensure the integrity of the contents of the bag 10.

For effecting opening of the pouring spout 24, a corner segment 60 of the bag 10 is torn away at the weakening lines or perforations 50 so as to produce a pair of gripping flanges 62 adjacent to the slide fastener structure 34 which, upon being pulled apart, will cause the interengaged profile male and female elements 36, 38 to separate responsive to the exerted pulling action, and thereby open the corner dispensing or pouring spout, such that tilting of the bag 10 facilitates dispensing therefrom of any desired quantity of the product stored in the bag.

Thereafter, upon the desired quantity of the bag contents, such as dry cereal, having been dispensed, it is merely necessary to align the profiled male and female elements 36, 38 in superposition, to apply pressure from externally thereof against the outer surfaces of the sidewalls 16, and to pressingly slide along the length of the structure 34 so as to ensure that the elements 36, 38 are interengaged along the full length thereof, and thereby produce a reclosed preferably hermetically sealed closure arrangement. This, of course, will assist in preserving the freshness and integrity of the stored contents, i.e. their shelf-life and storage ability over lengthy periods of time.

With regard to the ovoid self-supporting bottom structure of the bag 10, which is primarily an integral component of the container sidewall material, this merely requires that the lower end portions of the sidewalls 16 be extended outwardly and, in essence, then tucked in towards the bottom so as to form the generally ovoid-shaped curved bottom intermediate the linear bottom edge flanges which are also bowed convexly outwardly, and thereby, especially under the weight of the bag contents, are adapted to provide a bottom structure adapted to be self-supporting on a horizontal surface for maintaining the bag 10 in an upstanding upright condition.

Figure 9:
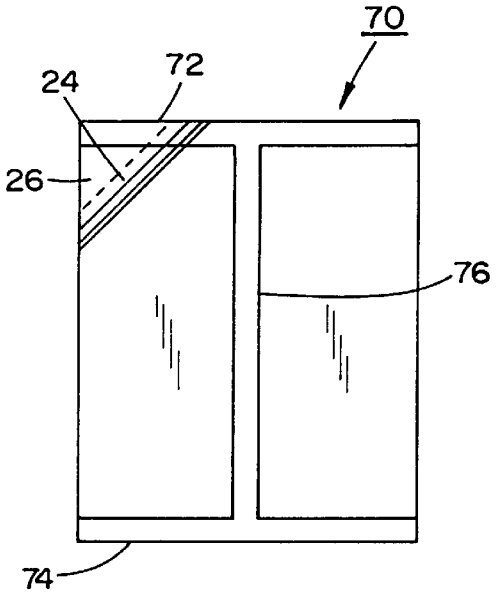
FIG. 9 illustrates a side view of a pillow-shaped flexible bag including a center fin or lap seal.
Figure 10:
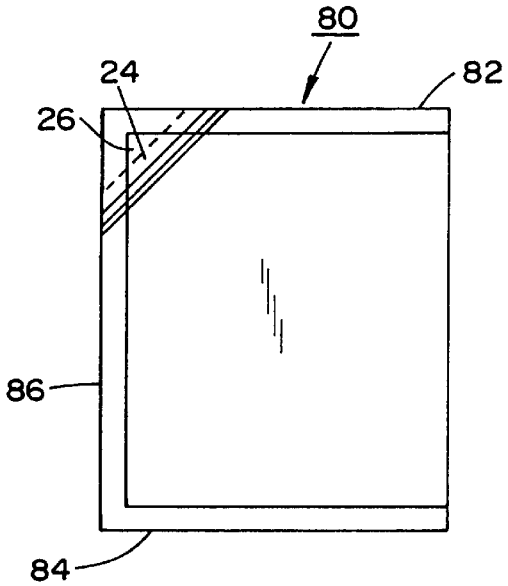
FIG. 10 illustrates a side view of a pillow-shaped flexible bag including a side seal.

Referring now in particular to the embodiments of FIGS. 9 through 12 of the drawings, shown are alternative container constructions, wherein the container might be either of a flexible or semi-rigid material, as illustrated in the various figures, wherein elements which are identical or similar to those shown in the preceding embodiments are identified by the same reference numeral, wherein FIGS. 9 and 10 illustrate, respectively, pillow-shaped or essentially knife-edge bottom bag-like containers.

Referring to FIG. 9, the bag 70 may include upper and lower seals 72, 74, and also a center fin or lap seal 76, as diagrammatically illustrated. The embodiment of FIG. 9 is essentially a traditional pillow-type package, in this instance, which may be employed for the packaging of ready-to-eat breakfast cereals. Generally, this type of pillow bag is manufactured and filled with the product on a vertical form and fill machine, and wherein the package normally has a center or off-center fin or lap seal in addition to the top and bottom seals. As illustrated in the alternative embodiment of the pillow bag 80, as shown in FIG. 10, in that particular embodiment, the pillow bag is provided with a top seal 82, a bottom seal 84 and a side seal 86. The bags may be adapted to be also formed by means of horizontal form and fill equipment which employ a variety of sealing patterns. The pillow bags 70, 80 which are illustrated in FIGS. 9 and 10 are generally adapted to be placed in an outer container, typically of a rectangular parallelipiped configuration, and which may be constituted of paper board, as is well known in the dry cereal packaging technology.

Figure 11:
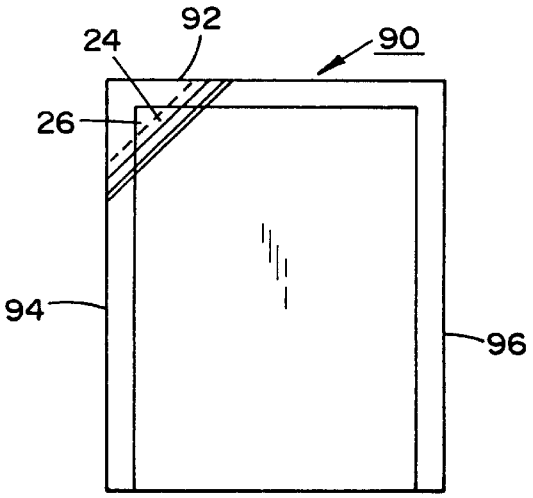
FIG. 11 illustrates a side view of a standup semi-rigid bag including top and side heat seals.
Figure 12:
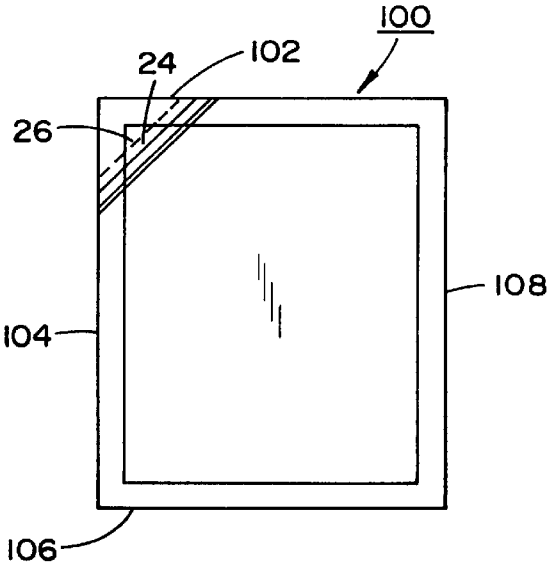
FIG. 12 illustrates a side view of a further embodiment of a standup semi-rigid bag.

Furthermore, FIGS. 11 and 12 illustrate, respectively, standup bags 90 and 100, in which the standup bag 90 as shown in FIG. 11 includes a top seal 92, and side seals 94, 96, which may be heat seals or the like. The bottom of the bag is expanded similar to that of shown in FIG. 1 of drawings so as to produce a self-supporting upstanding bag construction, which is preferably constituted of a semi-rigid material as described hereinabove.

With regard to the standup bag 100 shown in FIG. 12, this includes peripheral seal structures 102, 104, 106 and 108 wherein the bottom of the bag may be of an expanded self-supporting structure known generally as a "DOY-PACK".

The standup bags of FIGS. 11 and 12 are generally adapted to be employed without the need for external carton container structures.

Moreover, although the foregoing bags or containers have all been described with regard to generally dry food products, such as dry cereal, in various instances depending upon the type of material employed, the structures can also be used to store semi-moist shredded products, such as shredded cheese, coconuts and the like, in addition to various types of frozen food products.

The above structures clearly elucidate the advantages derived by the invention, and wherein the shorter slide fasteners or zipper length which is less than 50% of the width of the container or bag reduces costs associated with the provision of the slide fasteners in view of the reduction in material.

Furthermore, the use of the reclosable slide fasteners at the corner of the bag facilitate an easy first opening by cutting the outer portion of the corner by means of suitable scissors, or tearing off along weakening lines or the like. The zipper-like slide fasteners then provide for a seal structure which, preferably, may be a hermetic seal, and which fasteners are easy to align for reclosure of the bag or container.

The directional dispensing or forming of the spout at the corner provides for an ease in the dispensing of the product contained therein, and wherein the novel bag construction is adapted for both pillow bags and standup package structures.

From the foregoing, it becomes readily apparent that the present invention is directed to a novel and advantageous bag arrangement having a unique slide fastener forming a reclosable corner spout employed for the dispensing of the contents of the container, and the sealed reclosing thereof.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A reclosable container of a flexible material for the storage and dispensing of pourable contents, said container having a generally rectangular, tubular, sleeve-like or parallelepiped configuration including sealed top, bottom and side edges extending about opposed sidewalls of said container; and a resealable content dispensing aperture formed at the juncture of the top edge and at least one of said side edges between said sidewalls, said dispensing aperture being less than one-half the width of the top edge of said container and comprising:

(a) an angled container edge corner portion formed between said top edge and said at least one side edge;

(b) sealingly interengageable closure means consisting of profiled male and female closure members extending interiorly of said angled edge corner portion having selectively disengageable structure for opening of said dispensing aperture to enable dispensing of said contents through said aperture and being interengageable to sealingly reclose said aperture; and (c) said profiled male and female closure members projecting towards each other from facing inner wall surfaces of said opposing container sidewalls.

2. A reclosable container as claimed in claim 1, wherein said interengageable closure means comprise elastically deformable and resilient profiled elements.

3. A reclosable container as claimed in claim 1, wherein said profiled male and female closure members are located in superimposed alignment with each other so as to be sealingly engageable in response to external pressure slidingly applied thereto along the length of said closure means.

4. A reclosable container as claimed in claim 1, wherein said profiled male and female closure elements are inwardly offset from the angled container edge corner portion so as to form pull flanges toward said edge corner portion to facilitate opening of said dispensing aperture through disengagement of said male and female closure members.

5. A reclosable container as claimed in claim 2, wherein said profiled elements are formed integrally with the sidewalls of said container.

6. A reclosable container as claimed in claim 1, wherein said profiled male and female closure members each comprise strips adhesively fastened to mutually facing inner surfaces of the opposite container sidewalls.

7. A reclosable container as claimed in claim 1, wherein said profiled male and female closure members comprises tongue-and-groove fastener means.

8. A reclosable container as claimed in claim 1, wherein a heat seal is formed in said angled container edge portion in parallel spaced relationship with said interengageable closure means, said heat seal sealing said sidewalls prior to opening of the container and being separated upon opening of the container.

9. A reclosable container as claimed in claim 8, wherein said heat seal is located outwardly of said interengageable closure means.

10. A reclosable container as claimed in claim 8, wherein said heat seal is located inwardly of said interengageable closure means.

11. A reclosable container as claimed in claim 1, wherein said angled container edge corner portion is formed by detaching a corner segment of said container.

12. A reclosable container as claimed in claim 11, wherein said corner segment is detachable from said container along a weakening line located outwardly of said interengageable closure means.

13. A reclosable container as claimed in claim 12, wherein said weakening line is formed in said container sidewalls outwardly of a heat seal extending between said sidewalls in parallel spaced relationship with said interengageable closure means.

14. A reclosable container as claimed in claim 13, wherein said weakening line comprises perforations formed in said sidewalls.

15. A reclosable container as claimed in claim 13, wherein said weakening line comprises intermittent slits formed in said sidewalls.

16. A reclosable container as claimed in claim 13, wherein said weakening line is formed by laser scoring of the container wall surfaces.

17. A reclosable container as claimed in claim 1, wherein said container has a bottom configuration to enable said container to be self-supportingly upstanding on a horizontal supporting surface.

18. A reclosable container as claimed in claim 17, wherein said bottom configuration comprises said sidewalls expanding outwardly from the center portion of the container bottom, and wall structure extending between the lower portions of said sidewalls to form a container bottom surface.

19. A reclosable container as claimed in claim 18, wherein said container bottom surface is generally ovoid in transverse cross-section.

20. A reclosable container as claimed in claim 1, wherein said dispensing aperture is less than one-half the width of the upper edge of said container.

21. A reclosable container as claimed in claim 1, wherein said angled container edge corner portion subtends an angle within the range of about 25° to 65° with the container top edge.

22. A reclosable container as claimed in claim 1, wherein said material is a moisture and liquid-impervious plastic material.

23. A reclosable container as claimed in claim 22, wherein said container forms a bag of a single layer or multilayer construction of a material selected from the group of materials consisting of plastic, paper or metallized plastic.

* * * * *